United States Patent [19]

Morris

[11] 4,242,840

[45] Jan. 6, 1981

[54] WORKPIECE DRIVE WHEEL FOR A GRINDING MACHINE

[75] Inventor: Kenneth J. Morris, Durham, England

[73] Assignee: Smiths Industries, London, England

[21] Appl. No.: 63,496

[22] Filed: Aug. 3, 1979

Related U.S. Application Data

[63] Continuation of Ser. No. 901,031, Apr. 28, 1978, abandoned, which is a continuation-in-part of Ser. No. 801,931, May 31, 1977, abandoned, which is a continuation of Ser. No. 665,977, Mar. 11, 1976, abandoned.

[51] Int. Cl.³ ..... B24B 5/18

[52] U.S. Cl. ..... 51/236; 51/103 WH; 51/134.5 R; 51/165.92

[58] Field of Search ..... 51/103 WH, 236, 134.5 R, 51/165.92, 103 R, 165.77

[56] References Cited

U.S. PATENT DOCUMENTS

| | | | |
|---|---|---|---|
| 2,466,478 | 4/1949 | Riley | 51/103 WH |
| 2,605,591 | 8/1952 | Hill | 51/236 X |
| 2,626,488 | 1/1953 | Airlie | 51/236 X |
| 2,851,828 | 9/1958 | Todd | 51/103 R |
| 3,073,498 | 1/1963 | Hornbostel | 51/236 X |
| 3,178,861 | 4/1965 | Milias | 51/134.5 R |
| 3,589,077 | 6/1971 | Lenning | 51/165.92 |
| 3,798,846 | 3/1974 | Smith | 51/134.5 R |
| 3,877,180 | 4/1975 | Brecker | 51/165.92 |

*Primary Examiner*—Harold D. Whitehead

*Attorney, Agent, or Firm*—Pollock, Vande Sande & Priddy

[57] ABSTRACT

A drive wheel for rotating a workpiece while the latter is in contact with a grinding wheel during a grinding operation. The drive wheel is in the form of a pneumatic tire with a tire valve which permits easy variation of the internal pressure in the drive wheel. Thus the relative softness or hardness of the drive wheel can be changed in accordance with requirements attendant to the grinding operation. The drive wheel is motor-driven and a speed control device operates to slow the motor drive shaft when high torque loads are applied to the drive wheel by the workpiece, during heavy cutting of the workpiece by the grinding wheel. Thus the workpiece rotates slowly during heavy cutting and faster during light cutting.

5 Claims, 2 Drawing Figures

WORKPIECE DRIVE WHEEL FOR A GRINDING MACHINE

Figure 1:
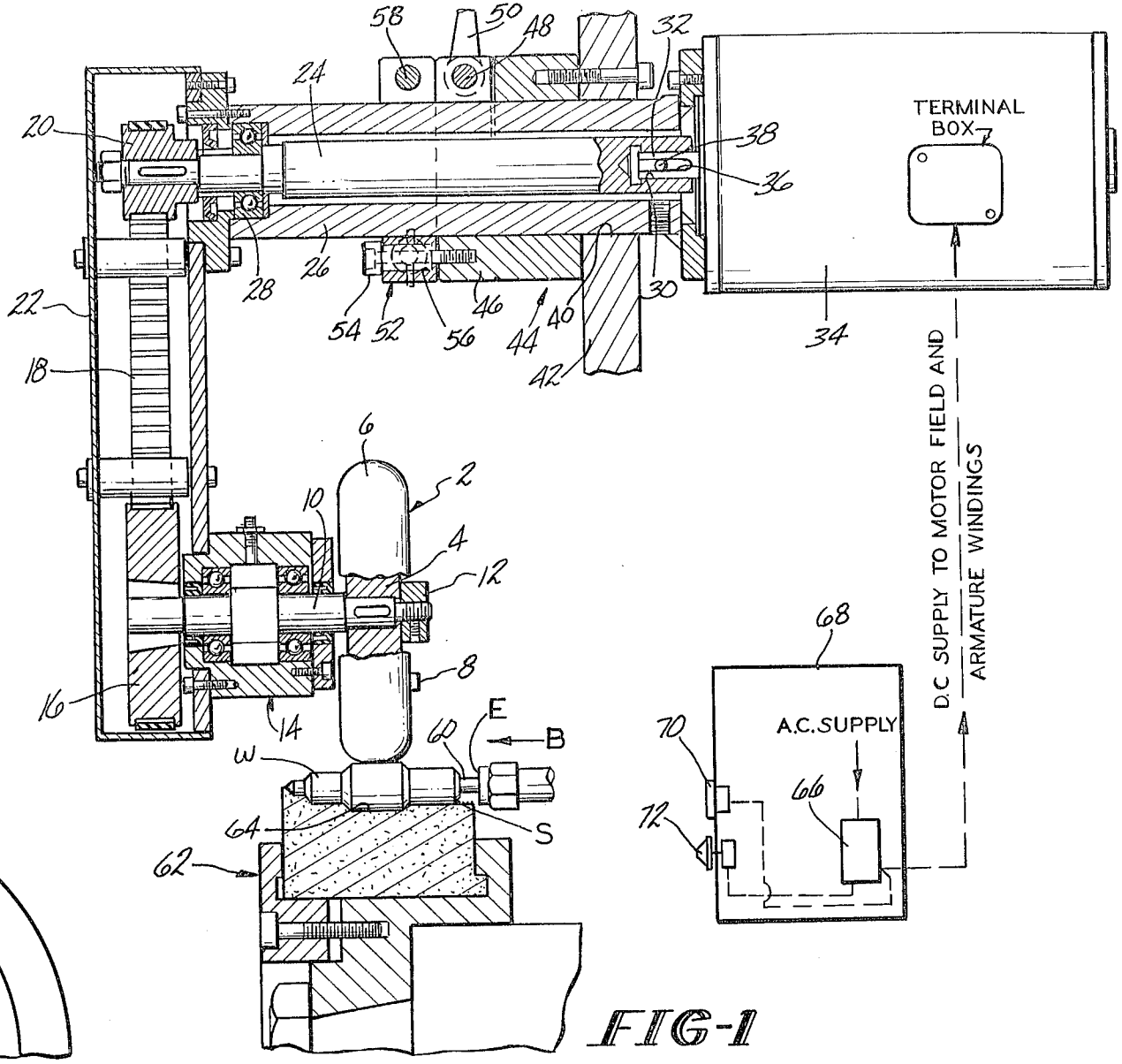

This is a continuation of application Ser. No. 901,031, filed Apr. 28, 1978 and now abandoned which was a continuation-in-part of application Ser. No. 801,931, filed May 31, 1977 and now abandoned, which in turn, was a continuation of application Ser. No. 665,977, filed Mar. 11, 1976 and now abandoned.

This invention relates to a drive wheel for rotating workpieces in grinding machines and particularly, although not exclusively, suitable for use in apparatus for grinding workpieces as described and claimed in copending Application Ser. No. 560,911, filed Mar. 21, 1975, now U.S. Pat. No. 3,950,895.

In the apparatus described in U.S. Pat. No. 3,950,895, generally tubular workpieces, such as spark plug insulators, are loaded onto mandrels projecting from a circular indexable head and are indexed around such that, over a determined arc of their travel on the indexable head, they are engaged by a rotating drive wheel mounted on an axis generally parallel to the axis of rotation of the indexable head whereby they are rotated on the mandrels and are brought into engagement with a profiled grinding wheel to be ground down to a determined size. It has been previously proposed to use solid rubber drive wheels or drive wheels faced with a sponge material and previously proposed to have the axis of the drive wheel movable through an arc and biased for movement around such arc towards a position of greatest engagement with the workpiece.

Attempts to increase the production speed of grinding of such workpieces above a rate of about 40 workpieces a minute have resulted in such a high proportion of breakages such that the increase in speed was not economical. Synchronous speed AC motors have generally been used in the past to give a substantially constant speed of rotation of the workpiece for the period in which the workpiece is engaged with the grinding wheel and is being ground thereby.

According to the invention, a drive wheel, for a grinding machine in which workpieces are engaged with the drive wheel to be rotated thereby and while rotating are brought into engagement with a grinding wheel, has a tire which can be inflated with air and a valve whereby the degree of inflation can be adjusted.

The axis of rotation of the drive wheel may be movable to increase the versatility of the device. The resilience of the tire is relied on to take account of the movement of the workpiece relative to the drive wheel as the workpiece is indexed around on the head. The tire may be moulded from natural rubber, synthetic rubber, polyurethane, PVC or other suitable elastomer and may if desired be reinforced with cords to permit it to be used with higher air pressures and to reduce creep.

A drive wheel with a tire according to the invention, can be much more resilient than previously proposed drive wheels and can thus conform more completely to the profile of the workpiece. This, for a given wheel loading, can permit a much greater area of contact between the drive wheel and the workpiece with a resultant increase in friction between the drive wheel and the workpiece over that which has previously been possible. The tire need, however, exert a much lower force on the blank thereby reducing stress, the likelihood of workpiece breakage, and wear of the mandrel on which the workpiece is mounted.

A pneumatic tire drive wheel according to the invention can greatly reduce the shock loading on the workpiece when the workpiece initially engages the drive wheel thereby again reducing the risk of breakage. Such a drive wheel, can, however, exert a much greater turning moment on the blank thereby permitting higher grinding rates than has previously been possible. Due to the resilience of the wheel, the drive wheel moves more gently into engagement with the workpieces and axial movement of the workpieces along the mandrels into engagement with a shoulder thereof is much more gentle with again a reduced likelihood of breakage.

A drive motor for the drive wheel is preferably a variable speed DC motor and may be provided with an electronic control which, while leaving the field current of the motor constant, varies the rotor current. The speed of such a motor is largely dependent on the load applied to the motor from the drive wheel and the electronic control can vary the slope of the torque curve of the motor.

Using a grinding wheel which rotates at a substantially constant speed and a regulated DC motor, the speed of grinding can be greatly increased since the rate of intersection of the path of the workpiece and the grinding wheel can be much higher than previously and the arc of movement of the workpiece over which grinding takes place can be lengthened. Thus, a drive wheel which unloaded rotates at about 500 r.p.m. may, under some conditions, be slowed to only about 20 r.p.m. as the workpiece moves into initial engagement with the drive wheel and the grinding wheel, whereby the bulk of the material to be removed from the workpiece can be removed during little more than a single revolution of the workpiece without significantly increased risk of breakage. The bulk of the material to be removed can thus be removed with the workpiece rotating at a low speed, with the workpiece speeding up for the final finish grinding as a result of speed-up of the drive wheel. Throughout the grinding operation, the rate of rotation of the grinding wheel stays substantially the same for maximum efficiency.

Figure 2:
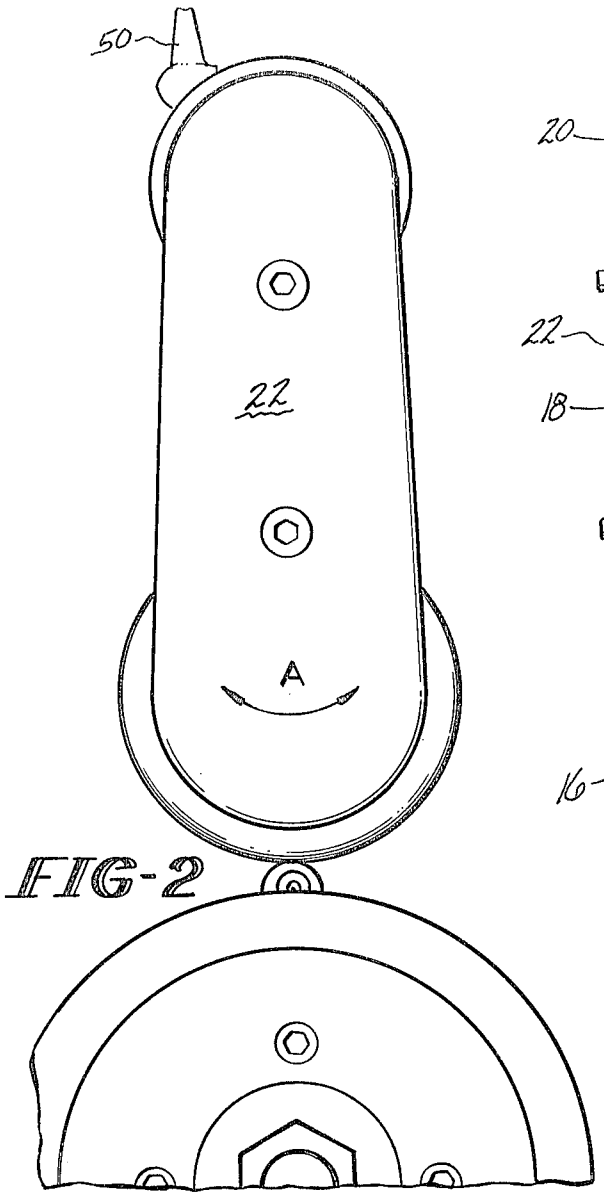

Further features of the invention are illustrated in the accompanying drawing, in which:

FIG. 1 shows a sectional view of a drive wheel workpiece and grinding wheel according to the invention; and FIG. 2 is an elevational view taken from the left side of FIG. 1.

Referring now to the drawings, there is shown in FIG. 1, a preferred arrangement for the drive wheel, workpiece, and grinding wheel. The drive wheel 2 includes a hub portion 4 on which is mounted an inflated pneumatic tire 6. A conventional inflation valve 8 is housed on the hub 4 for varying the air pressure in the tire 6. The hub 4 is keyed to a shaft 10 and held thereon by a nut 12, whereby the drive wheel 2 rotates with the shaft 10. The shaft 10 is journalled in a bearing assembly 14 and has secured to it, at its end remote from the drive wheel 2, a pulley 16. The pulley 16 engages one end of an endless drive belt 18, the other end of which engages a drive pulley 20. The pulley-belt mechanism is housed in a casing 22 to protect against accumulation of grit, dust, and the like on the mechanism. The drive pulley 20 is keyed to a drive shaft 24 which is contained in a tubular housing 26. The outer end of the drive shaft 24 is journalled in a bearing assembly 28 contained within the tubular housing 26. The inner end of the drive shaft 24 is provided with a bore 30 into which projects the armature 32 of an electric motor 34. The electric motor 34 is preferably a constant torque variable speed DC 0.25 H.P.×1500 rpm motor manufactured by GEC Machines, Ltd., West Yorkshire, England, Model No. MD 7175. The connection between the drive shaft 24 and motor armature 32 is made with a slot 36 and pin 38 which permits longitudinal adjustment to some degree of the drive shaft 24. The drive shaft housing 26 extends through an opening 40 in the machine frame 42 (only fragmentarily shown) and through a first collar 44 which is bolted to the machine frame 42. The collar 44 has a split end part 46 which may be tightened or loosened by a toggle bolt 48 having a laterally projecting handle 50. Loosening of the bolt 48 will enable the housing 26 and drive shaft 24 to be moved longitudinally thereby causing a resultant adjustment in the position of the drive wheel 2. A second split collar 52 is mounted on the housing 26 and connected to the first collar 44 by means of a bolt 54 which extends through a laterally elongated hole 56 in the second collar 52. A cinching bolt 58 permits tightening and loosening of the second collar 52 on the housing 26. When the second collar 52 is loosened, the housing 26 and shaft 24 may be twisted about their axis thereby causing the lower end of the casing 22 to swing in the direction of arrow A (see FIG. 2) whereby the drive wheel 2 can be angularly adjusted for driving different size workpieces. Additionally, the angle of the axis of the drive wheel 2 can be shifted slightly, on the order of about one or two degrees by placing a shim between the collar 44 and the machine frame 42, thereby slightly cocking the drive shaft 24 and its housing 26. This enables the drive wheel 2 to push the workpiece W in the direction of the arrow B so that the end E of the workpiece W will be biased against a reference shoulder 5 on the workpiece-holding mandrel 60.

The control means 66 which controls the torque generated by and rotational speed of the motor armature in response to the load applied to the drive wheel 2 is preferably contained in the main electrical cabinet 68 mounted conveniently on the machine frame. A tachometer 70 is connected to the control 66 so that the exact speed of the control wheel 2 can be observed. A rheostat 72 may also be connected to the control to permit manual changing of the armature current and torque, and hence drive wheel rotational speed. The control 66 is preferably a "Hainsworth" "Speed Ranger" type CU controller 519/6000 sold by J. H. Fenner & Co. (Power Transmission) Ltd. of Marfleet, Hull, England.

The workpiece W is mounted on a mandrel 60 for rotational movement about its axis when it is engaged by the drive wheel 2. A grinding wheel 62 having a profiled grinding surface 64 engages the workpiece W to properly grind the outer surface thereof. The grinding wheel is preferably driven at a constant high speed of rotation. A constant high rotational speed for the grinding wheel is preferably because loading of the grinding wheel with particulate material from the workpiece is thereby minimized.

It will be readily apparent that the use of a pneumatic tire as a drive wheel for a grinding machine will provide improvements in performance over conventional hard or soft rubber drive wheels. The softness of the tire can be varied by varying the pressure of inflation of the tire so that the force of impact of the tire on the workpiece can be minimized with a resulting lowering of breakage of the workpieces. Pneumatic tire drive wheels can also provide an increased area of contact with the workpiece being rotated so as to permit a more controlled rate of rotation despite uneven dimensions or possible eccentricities on the outer surface of the workpiece. By varying the speed at which the drive wheel is rotated during the grinding operation, it is possible to perform a majority of fine grinding at a relatively high speed of workpiece rotation for improved finish.

It will also be appreciated that while application of the pneumatic control wheel has been specifically disclosed in connection with a grinding machine, the invention is equally usable with any type of cutting machine which performs a cutting operation on a workpiece is rotated during the cutting operation by a control wheel.

Since many changes and variations of the disclosed embodiment of the invention may be made without departing from the inventive concept, it is not intended to limit the invention other than as required by the appended claims.

What is claimed is:

1. Apparatus for cutting stock off of a preformed workpiece, said apparatus comprising:
(a) cutting means engageable with the workpiece for performing a cutting operation thereon;
(b) workpiece support means for rotatably supporting a workpiece to be cut by said cutting means;
(c) inflatable drive wheel means for frictionally engaging a workpiece to press the workpiece against said cutting means and to rotate the workpiece during a cutting operation;
(d) variable speed DC motor drive means capable of generating an output torque for rotating said drive wheel means; and
(e) control means electrically connected to said drive means for maintaining said drive means output torque at a substantially constant level during the entire cutting operation, thereby minimizing the length of the cutting operation without transmitting excessive force between said inflatable drive means and said workpiece.

2. A grinding machine comprising:
(a) a rotatable grinding wheel which is driven at a substantially constant rotational speed during an entire grinding operation;
(b) workpiece support means for rotatably supporting a workpiece to be ground by said rotatable grinding wheel;
(c) inflatable drive wheel means for frictionally engaging the workpiece to press the workpiece against said rotatable grinding wheel and to rotate the workpiece during the entire grinding operation;
(d) variable speed DC motor drive means for rotating said drive wheel means; and
(e) control means electrically connected to said drive means for maintaining said DC motor drive means output torque at a substantially constant level during the entire grinding operation, whereby initial rough grinding of the workpiece is accomplished at relatively slow workpiece rotational speeds and subsequent, fine grinding of the workpiece is accomplished at relatively faster workpiece rotational speeds.

3. A grinding machine according to claim 2 wherein said inflatable drive wheel means comprises a central, rotatable hub portion and an annular elastomeric tire mounted on said hub portion, with an annular sealed chamber formed therebetween.

4. A grinding machine according to claim 3, wherein said drive wheel means further comprises a valved passageway extending through said elastomeric tire into said annular sealed chamber for introducing a pressurized fluid into said annular chamber.

5. A grinding machine according to claim 2 wherein said control means comprises an open-loop electrical assembly providing a substantially constant level of direct current to said variable speed drive means for providing a substantially constant output torque to said drive wheel means throughout the entire grinding operation.

* * * * *